US005536231A

United States Patent [19]

Nilsson

[11] Patent Number: 5,536,231

[45] Date of Patent: Jul. 16, 1996

[54] APPARATUS AND METHOD FOR PICKING AND ERECTING CARTON BLANKS

[75] Inventor: Jan-Östen Nilsson, Mt. Prospect, Ill.

[73] Assignee: Tetra Laval Holdings & Finance S.A., Pully, Switzerland

[21] Appl. No.: 263,081

[22] Filed: Jun. 21, 1994

[51] Int. Cl.[6] ..... B31B 1/76; B31B 1/78; B31B 1/80

[52] U.S. Cl. ..... 493/315; 493/312

[58] Field of Search ..... 493/312, 313, 493/315, 316, 317

[56] References Cited

U.S. PATENT DOCUMENTS

| | | | |
|---|---|---|---|
| 2,512,922 | 6/1950 | Dearsley . | |
| 2,699,712 | 1/1955 | Meyer-Jagenberg | 493/316 |
| 2,837,983 | 6/1958 | Kovac . | |
| 2,887,021 | 5/1959 | Duffy et al. . | |
| 2,966,100 | 12/1960 | Engleson | 493/317 |
| 3,242,827 | 3/1966 | Winters . | |
| 4,194,442 | 3/1980 | Martelli | 493/315 |
| 4,583,965 | 4/1986 | Argazzi | 493/313 |
| 4,871,348 | 10/1989 | Konaka . | |
| 4,881,934 | 11/1989 | Harston et al. . | |
| 5,061,231 | 10/1991 | Dietrich et al. . | |

FOREIGN PATENT DOCUMENTS

| | | |
|---|---|---|
| 0376408A1 | 7/1990 | European Pat. Off. . |
| 0472182A1 | 2/1992 | European Pat. Off. . |
| 0510953A1 | 10/1992 | European Pat. Off. . |

*Primary Examiner*—Jack W. Lavinder
*Attorney, Agent, or Firm*—McAndrews, Held & Malloy Ltd.; Patrick N. Burkhart

[57] ABSTRACT

An apparatus for erecting folded carton blanks has a picking assembly for grasping a carton blank from a magazine. The picking assembly is disposed for rotational movement from a first position proximate the magazine to a second position proximate an abutment that engages a corner of the carton blank. A gate disposed for rotational movement is driven in a timed relation with the picking assembly. As the picking assembly moves from its first to its second position, the gate applies a breaking pressure which facilitates air flow through the interior of the carton blank. At or immediately prior to the time that the corner of the carton blank engages the abutment, the gate applies an erecting force that facilitates opening the carton blank to its fully erected state.

21 Claims, 9 Drawing Sheets

APPARATUS AND METHOD FOR PICKING AND ERECTING CARTON BLANKS

FIELD OF THE INVENTION

The present invention relates generally to an apparatus for picking and erecting carton blanks. More particularly, the present invention relates to an apparatus for picking collapsed tubular carton blanks and erecting them at increased operation speed for use in food and other packaging systems.

BACKGROUND OF THE INVENTION

Machines that are capable of picking a carton from flat folded tubular blank stock and erecting the carton are known in the art. Typically, a plurality of flat folded tubular carton blanks are fed into a magazine from which the carton blanks are sequentially withdrawn by, for example, a vacuum picking/erecting mechanism.

U.S. Pat. Nos. 2,881,021 and 3,242,827, and European Patent Application No. 472,182A1, describe three such vacuum picking/erecting mechanisms. In each of the devices described in these references, the vacuum picking/erecting mechanism operates to grasp the outermost carton blank from the magazine through the application of sub-atmospheric pressure and to pull the carton blank to an erect state. In the U.S. Pat. No. '021 patent, the flat folded carton is grasped by a picking arm and is completely unfolded solely through the use of a lever arm that applies diagonal pressure to the carton blank. In the U.S. Pat. No. '827 patent, a lever arm is not employed. Instead, the picked carton blank is unfolded by a further suction mechanism that exerts a pulling force on an opposing panel of the carton blank. The unfolded carton is then guided into position for further processing to form a filled and sealed container. The European Application discloses a device that uses a roller in combination with a vacuum plate to pick and erect the carton blank.

One of the significant limitations of such prior art machines is their inability to operate simply and reliably at high rates of speed. For example, in the case of the lever operated unfolding mechanism of the device disclosed in the U.S. Pat. No. '021 patent, there is a problem with providing adequate air flow into the carton blank as it is picked and unfolded. Because the tubular blanks are virtually flat and, further, are compressed under the weight of other carton blanks during shipping and storage, it is difficult to separate opposing panels. It therefore becomes necessary to provide for adequate air flow into the interior of each carton blank as it is unfolded. If there is insufficient air flow into the carton blank, the carton will not unfold into an "open" or erect position but, rather, will simply fold over upon itself, recollapsing to a "closed" position. Thus, when such a lever type unfolding mechanism is employed, the lever arm must operate at a sufficiently low rate of speed to allow adequate time for the carton blank to receive air at its interior.

Machines which employ a further suction mechanism to unfold the carton blank, such as the one disclosed in the U.S. Pat. No. '827 patent, and those that use a roller in combination with a vacuum plate, such as the one disclosed in European Patent Application No. 472,182A1, suffer from the typical problems inherent in more complicated systems. Since these mechanisms involve a greater number of parts, they inherently have greater initial costs, maintenance expenses, and noise levels.

SUMMARY OF THE INVENTION

An apparatus and method are disclosed for picking a folded carton blank from a magazine and erecting the carton blank into a generally rectangular tube. The apparatus includes an abutment that is mounted to align with a first corner of the carton blank as the carton blank is being erected. A picking arm is used to grasp a face of the carton blank and remove the carton blank from the magazine. The picking arm moves from a first position in which it engages the face of the carton in the magazine to a second position in which the carton blank engages the abutment. A gate is disposed on the apparatus and is adapted to engage the carton blank as the picking arm moves the carton blank toward the abutment thereby applying an initial breaking force to the carton blank which facilitates air flow into the interior of the carton blank. The gate is further operable to apply an erecting force to the carton blank after the carton blank has been initially broken. This erecting pressure urges the carton blank against the abutment to a fully erect state.

In accordance with one embodiment of the apparatus, the picking arm includes a manifold that may be connected to a vacuum generator. At least one suction cup is placed in fluid communication with the manifold, the suction cup being used to engage the carton blank. A base member is disposed for rotation about an axis while at least one arm connects the base member to the manifold.

The picking arm and gate may each be connected to a drive mechanism which moves the picking arm and the gate in a timed relationship. The drive mechanism drives the gate from a first position in which the gate applies the initial breaking force to a second position in which the gate applies the erecting force. Further, the drive mechanism drives the picking arm from a first position in which the picking arm engages the carton blank at the magazine to a second position in which the carton blank engages the abutment.

Optionally, the drive mechanism maintains the gate in its first position for a period of time in which the picking arm is moved from its first position to its second position. This movement of the picking arm from its first position to its second position urges the carton blank against the gate to apply the breaking force.

Several types of drive mechanisms may be suitable for use in the apparatus. In accordance with one type of drive, a first servomotor is connected to drive the picking arm while a second servomotor is connected to drive the gate. A controller is connected to the first and second servomotors to control the timing of the movement of the picking arm and the gate.

In accordance with another type of drive mechanism, a timing chain is utilized to maintain synchronism of operation between a packaging machine and the disclosed apparatus. A first gearing mechanism is disposed between the timing chain and the picking arm for effecting timed movement of the picking arm. A second gearing mechanism is disposed between the timing chain and the gate for effecting timed movement of the gate.

In accordance with a still further type of drive mechanism, the drive includes a first crank assembly connected to drive the picking arm and a second crank assembly connected to drive the gate.

Other objects and advantages of the present invention will become apparent upon reading the following detailed description and appended claims, and upon reference to the accompanying drawings.

DETAILED DESCRIPTION OF THE PREFERRED EMBODIMENT

Figure 1:
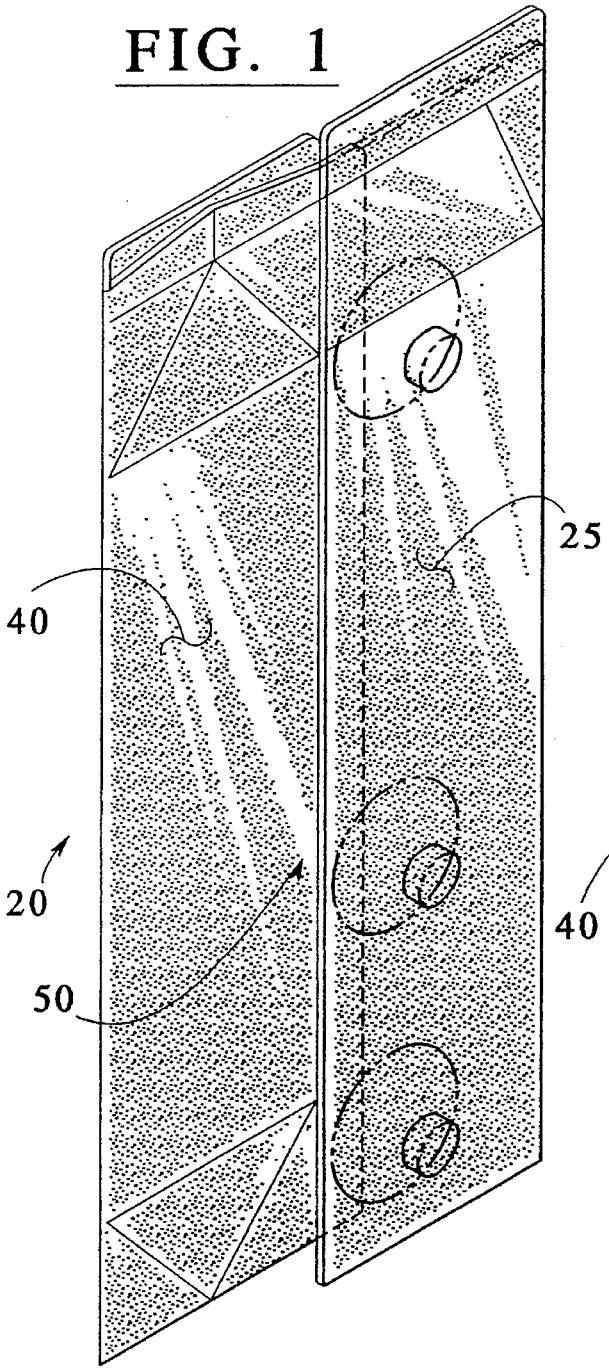
FIG. 1 is a perspective view of a flat folded tubular carton blank suitable for use with the disclosed apparatus.
Figure 2:
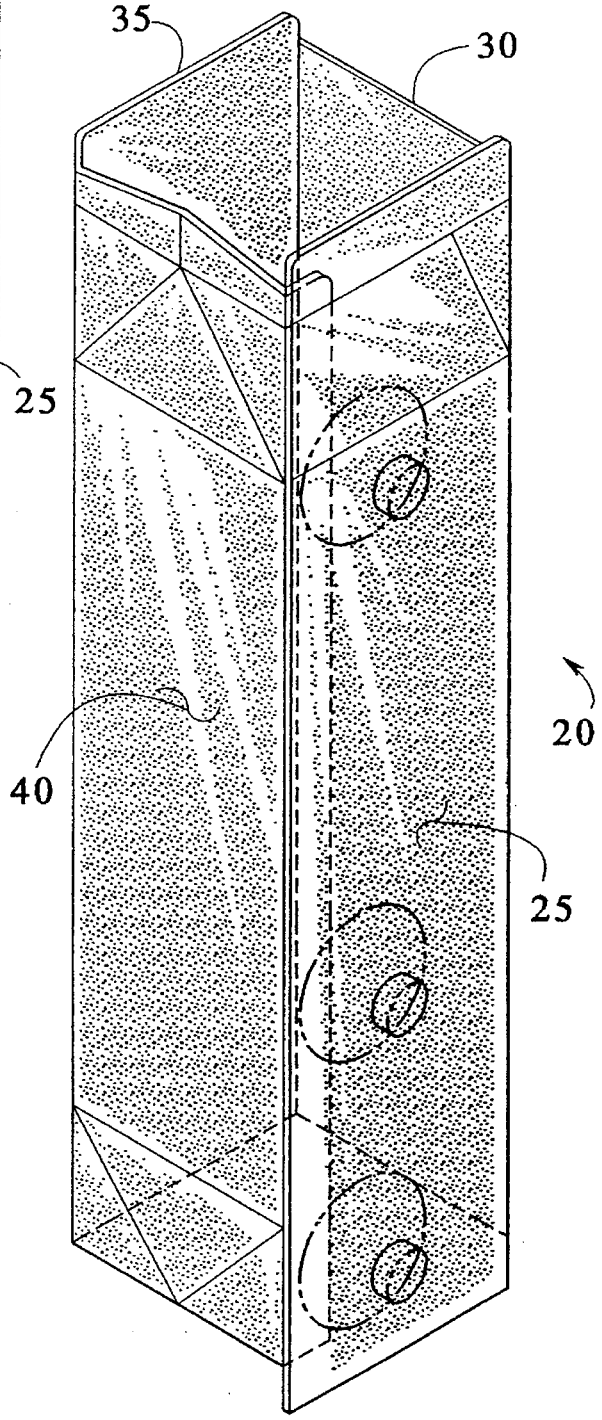
FIG. 2 is a perspective view of an unfolded tubular carton blank suitable for use with the disclosed apparatus.

FIGS. 1 and 2 are perspective views of one of the many types of tubular carton blanks that may be used with the disclosed apparatus. In FIG. 1, the carton blank 20 is in a flattened state while FIG. 2 illustrates the carton blank in its erected state.

Carton blank 20 may be, for example, a laminated paper construction that is cut and side-sealed to form tubular stock. Each carton blank 20 is scored to define at least four side-by-side panels, namely a first panel 25, a second panel 30 a third panel 35, and a fourth panel 40. Additional score lines are likewise provided. The score lines define fold-lines that allow the carton blank to be folded into the familiar gable top carton. Such cartons are used to package a variety of goods including juices and the like. As shown in FIG. 1, when folded flat, panels 25 and 40 of carton blank 20 form a front facing side 50 that may be 20 gripped by suction cups.

Figure 3:
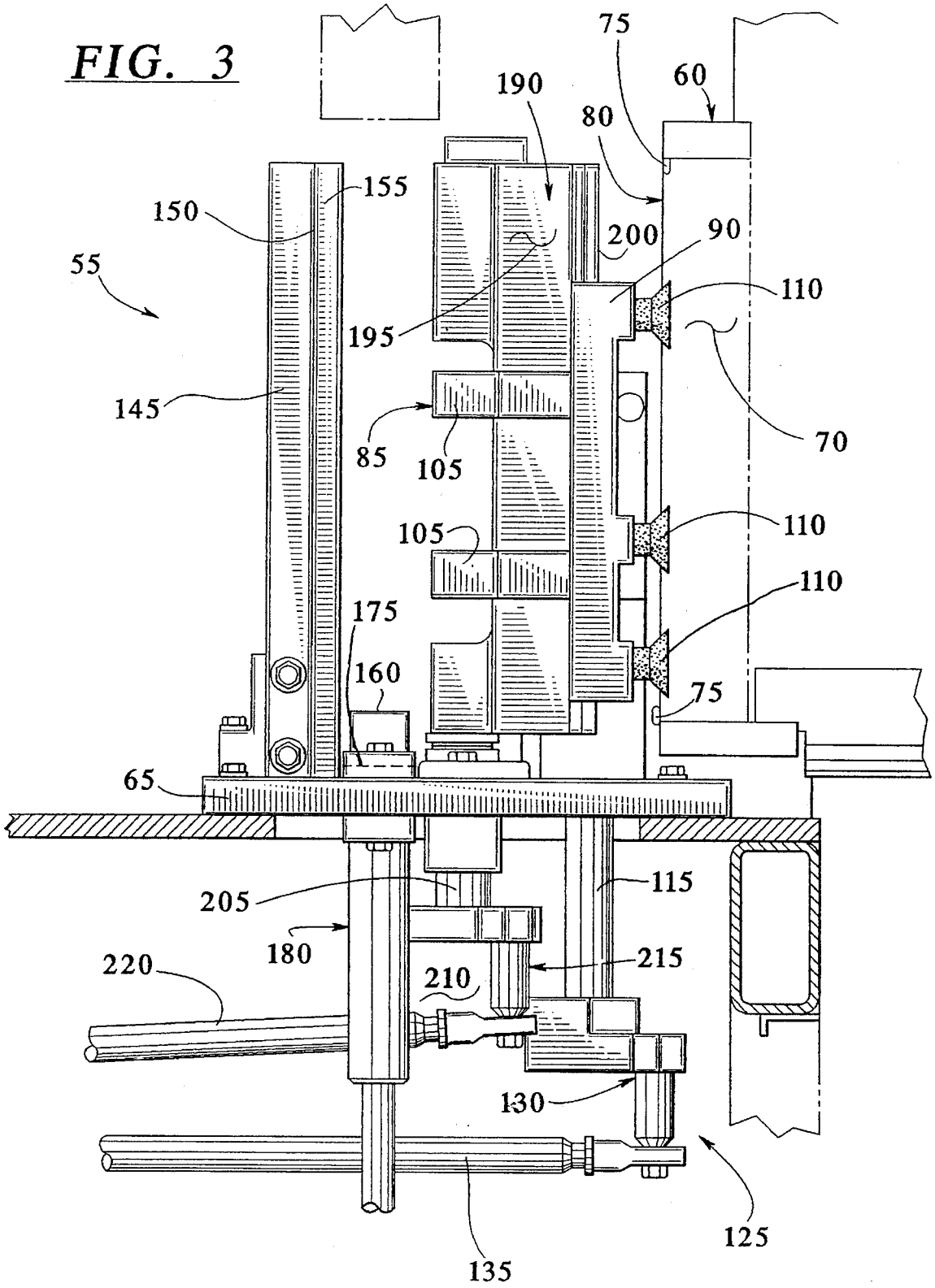
FIG. 3 is a side view of one embodiment of a carton picking/erecting apparatus.
Figure 4:
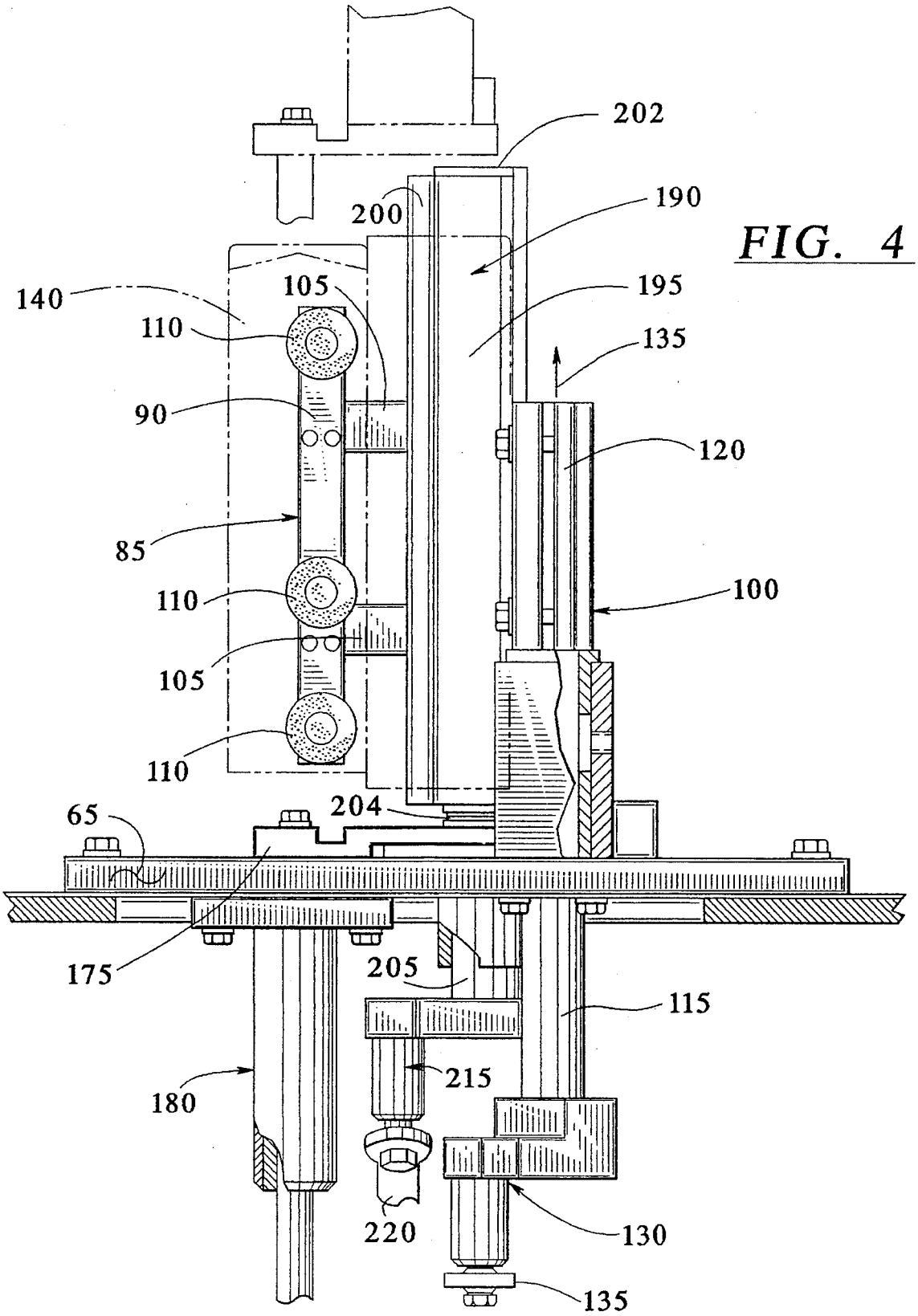
FIG. 4 is a front view of the carton picking/erecting apparatus illustrated in FIG. 3.

FIGS. 3 and 4 are perspective views of a carton erecting apparatus, shown generally at 55. As illustrated, a magazine 60 is positioned vertically on a horizontal base 65. Magazine 60 supports and feeds a plurality of collapsed tubular carton blanks that are arranged to form a ream of carton blank stock 70. The flat folded tubular blanks of the stock 70 are each vertically and uniformly positioned in a lateral array between a magazine advancing mechanism (not shown) and retainers 75 at the dispensing side 80 of the magazine 60. One such magazine advancing mechanism includes a longitudinally slidable member that applies constant pressure to the stock 70 to urge the carton blanks toward the retainers 75. The retainers 75 may be formed as a plurality of projections that extend from the frame of the magazine 60. As each carton blank reaches the dispensing side 80 of the magazine 60, it engages the retainers 75.

FIGS. 3 and 4 also show a picking arm assembly, shown generally at 85. The assembly 85 includes a manifold 90 connected to a rotational base assembly, shown generally at 100, by arms 105. A plurality of suction cups 110 are positioned on the manifold 90. Suction cups 110 communicate with a vacuum generator (not shown), for example, through manifold 90. The vacuum generator may communicate with the manifold 90 directly through vacuum hoses or, alternatively, through vacuum air passages disposed in the base assembly 100 and arms 105.

The picking assembly 85 is disposed for activation by a shaft 115 that extends through baseplate 65. For example, the shaft 115 and the base assembly 100 may be interconnected for co-rotation.

The shaft 115 may be activated by a crank assembly, shown generally at 125, which includes a crank 130 and crankshaft 135. The crankshaft 135 is attached to a drive mechanism (not illustrated) which, for example, may be a servomotor. Other suitable drive mechanisms may also be used.

Figure 5:
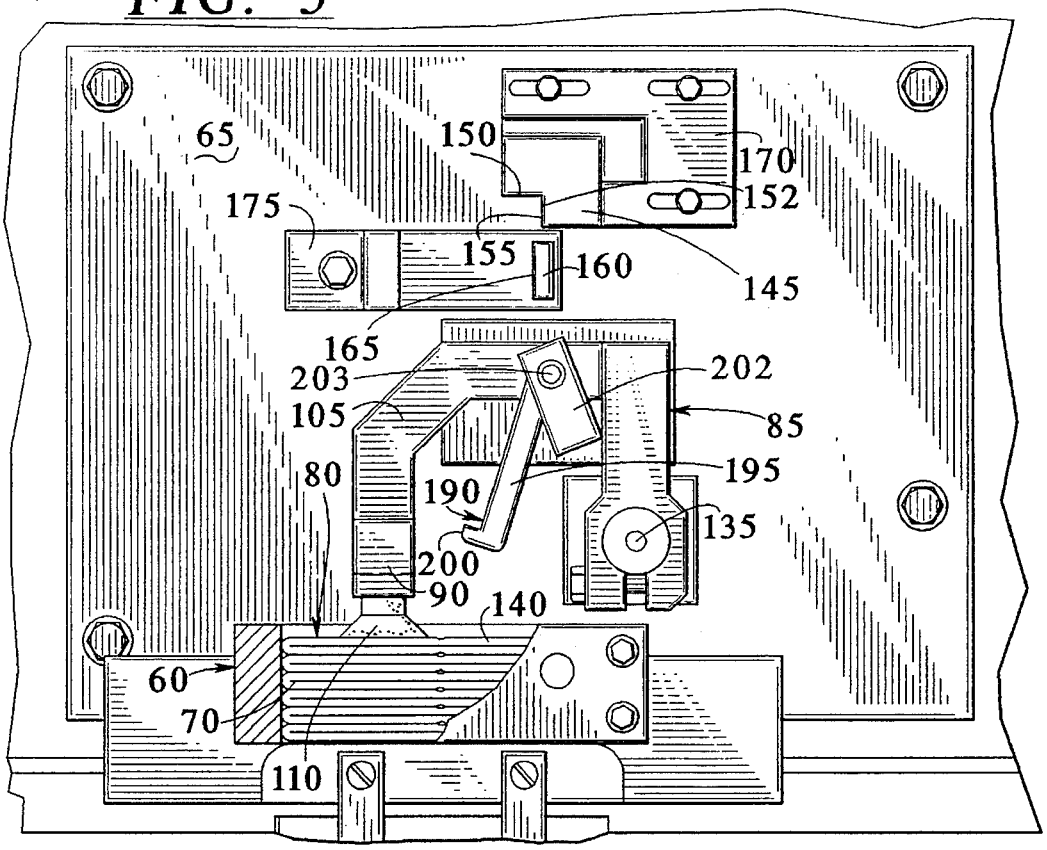
FIG. 5 is a top view of the carton picking/erecting apparatus of FIG. 3 illustrating the gate and picking assembly in their respective first positions.
Figure 6:
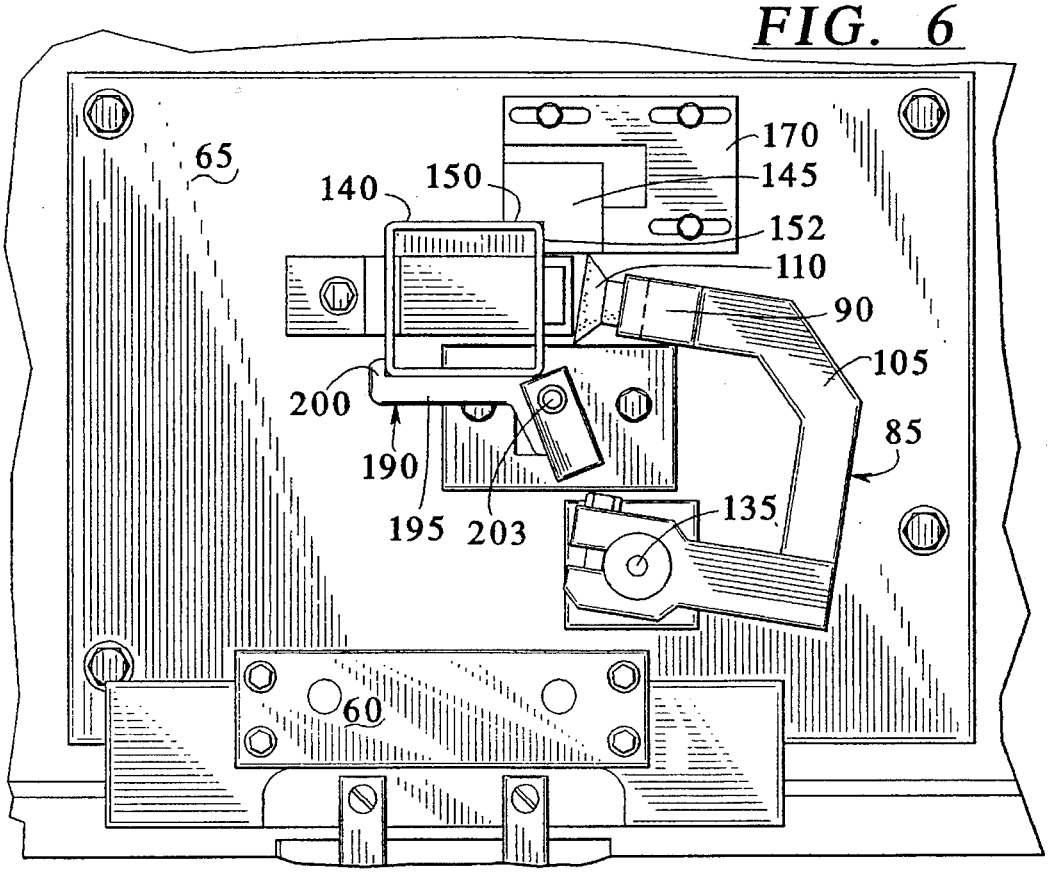
FIG. 6 is a top view of the carton picking/erecting apparatus of FIG. 3 illustrating the gate and picking assembly in their respective second positions.

Turning now to FIGS. 5 and 6, the manifold 90 and suction cups 110 are disposed on the base 65 for arcuate movement about axis 135 upon the application of a rotary force by the crank assembly 125. More particularly, the suction cups 110 on the manifold 90 move in an arcuate fashion from an advanced position proximate the dispensing side 80 of the magazine 42 (see FIG. 5) to a retracted position approximately ninety degrees from the advanced position (see FIG. 6). When the suction cups 110 and manifold 90 are in their advanced position, the suction cups 110 are placed in contact with the end carton blank 140 of blank stock 70.

As also shown in FIGS. 3–6, an elongated abutment member 145 is in a fixed position on the top of baseplate 65 at a location coinciding with the corner of a carton blank as the carton blank is erected. The abutment member 145 has a first receiving surface 150 that is generally parallel to a plane formed at the dispensing end 80 of magazine 60. A second receiving surface 152 is generally perpendicular with the dispensing side 80 of magazine 60. A further abutment 160 is also disposed on baseplate 65 and has a face portion 165 that is parallel to the receiving surface 155.

The abutment member 145 may be mounted to an adjustable mounting plate 170 to vary the position of the abutment to accommodate various carton sizes. Likewise the plate 175 may be adjustable.

The plate 175 and abutment 160 may be connected to a piston assembly 180 to form a lifter mechanism. The piston assembly 180 may be used to lift the plate 175 and abutment to urge a fully erected carton into a position in which the carton may be transferred to, for example, a conveyor.

As is also shown in FIGS. 3–6, the picking/erecting apparatus also includes a gate 190 that includes an elongated body 195 and a hooked end 200. The gate 190 is disposed for actuation by shaft 205 that extends through baseplate 65. For example, shaft 205 and gate 190 may be connected to one another for co-rotation. Gate 190 may be supported by a gate support assembly 202 that engages the upper and lower portions of gate 190 and, further, allows rotation of the gate 190 about rotation axis 203. Rotational movement between gate 190 and support 202 is facilitated by, for example, bearings 204.

Shaft 205 is associated with a further crank assembly 210, that includes crank 215 and crankshaft 220. The crank assembly 210 may, for example, be driven by a lever arm and cam, a servomotor, or, for example, may be linked through a gearing mechanism to a timing chain of a packaging machine that utilizes the presently disclosed apparatus.

When the crank assembly 210 drives shaft 205, gate 190 moves in an arcuate fashion from a first position extending towards the dispensing side of magazine 60 (as shown in FIG. 5) to a second position in which the hook end 200 engages a corner of the carton 140 diagonal from the abutment 145.

The movement of the picking assembly 85 and the movement of the gate 190 are drawn to a particular timed relationship. The timed relationship may be achieved, for example, by driving both the crank assemblies 125 and 210 with a common drive motor or mechanism.

Figure 7:
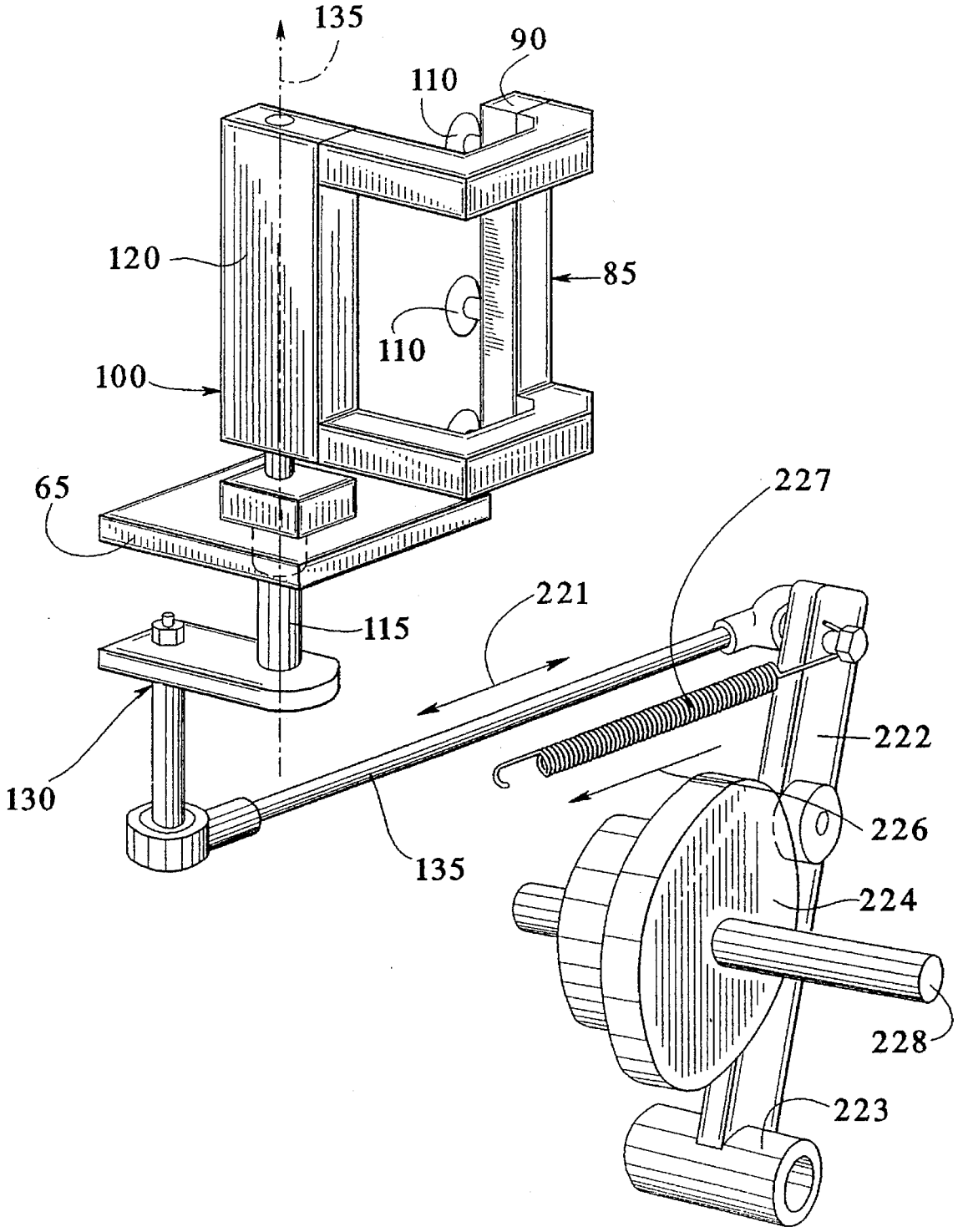
FIGS. 7–10 illustrate several types of drive mechanisms suitable for use in the picking/erecting apparatus disclosed.
Figure 8:
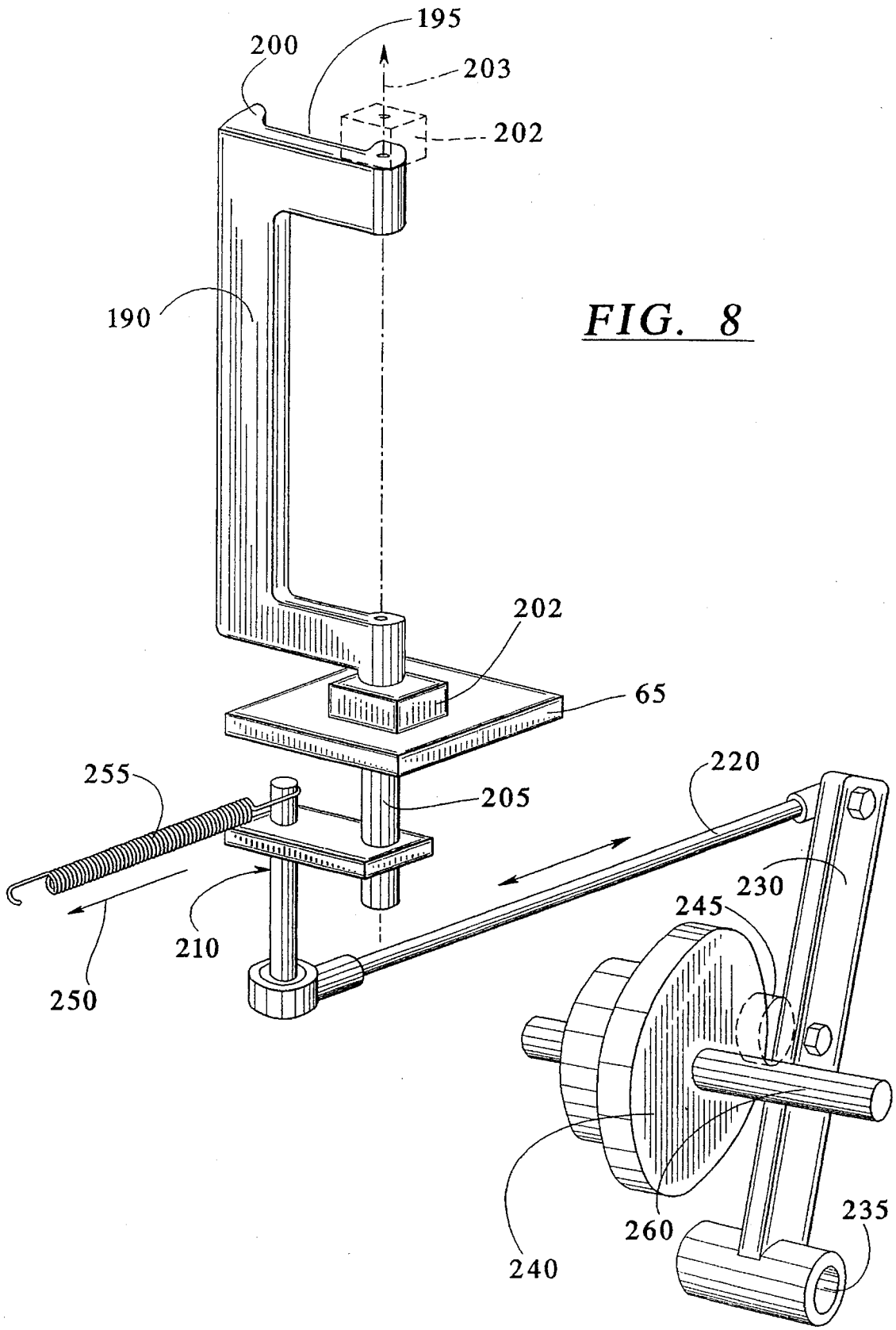

FIGS. 7 and 8 illustrate one manner in which the crank assemblies 125 and 210 may be driven. As illustrated, rotation of the picking assembly 85 about axis 135 may be achieved by driving the crankshaft 135 with a back and forth motion illustrated by arrow 221. The crankshaft 135 is driven by a lever arm 222 that pivots about a fulcrum 223. The lever arm 222 is driven by a cam 224 that engages a roller 226 disposed on the lever arm 222. The lever arm 222 is biased in the direction shown by arrow 226 by, for example, a spring 227. The cam 224 includes a drive shaft 228.

In a similar fashion, the gate 190 is rotated about axis 203. The crankshaft 220 associated with the gate 190 is connected to a lever arm 230 which pivots about a fulcrum 235. The lever arm 230 is driven by a cam 240 that engages a roller 245 disposed on the lever arm 230. The crank 210 is biased in the direction of arrow 250 by, for example, a spring 255. The cam 240 includes a drive shaft 260.

Figure 9:
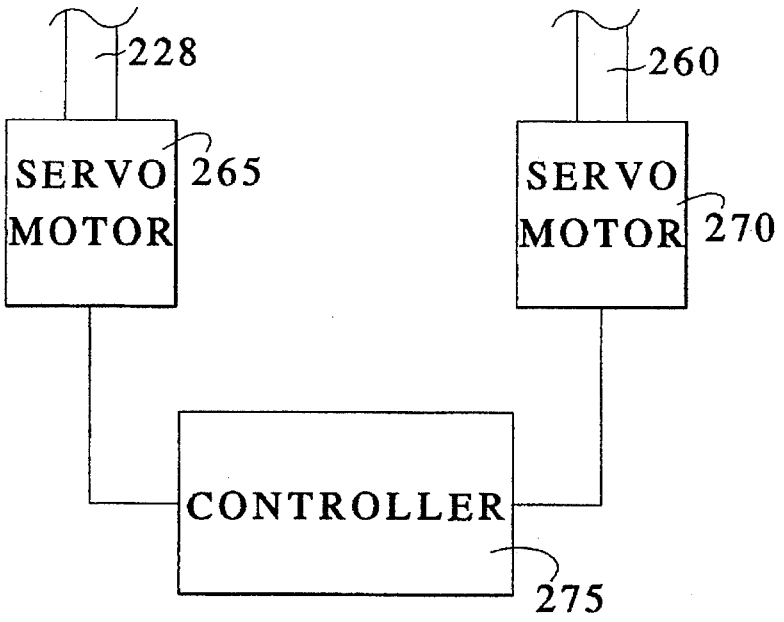
Figure 10:
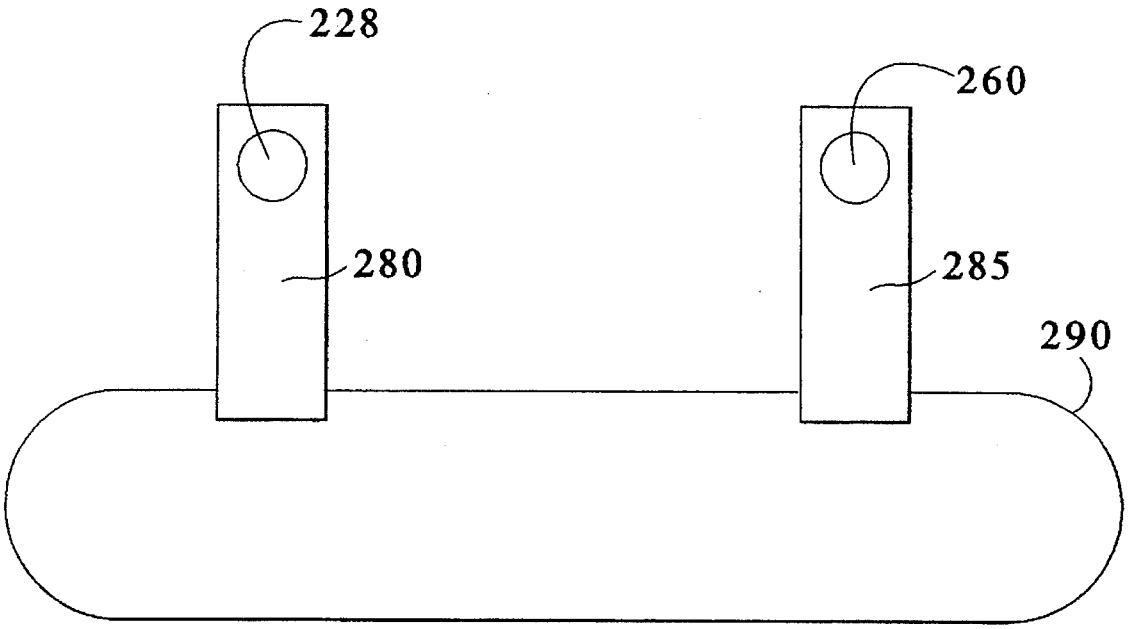
Figure 11:
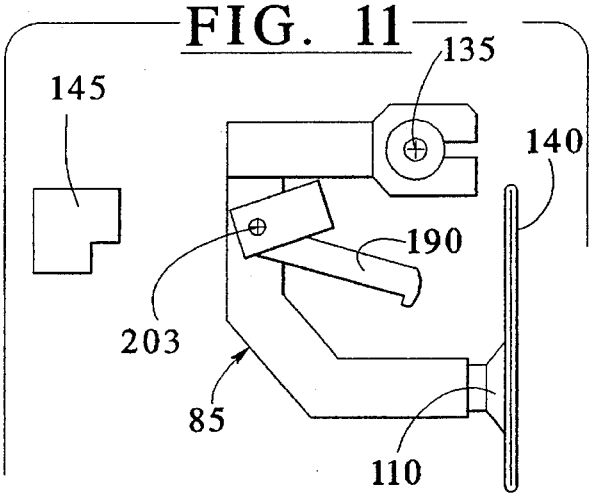
FIGS. 11–16 are partial top views of the carton picking/erecting apparatus illustrating the relative movement of the picking assembly and the gate.
Figure 12:
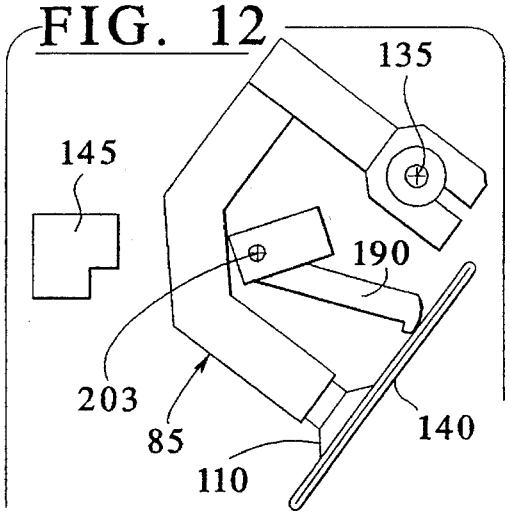
Figure 13:
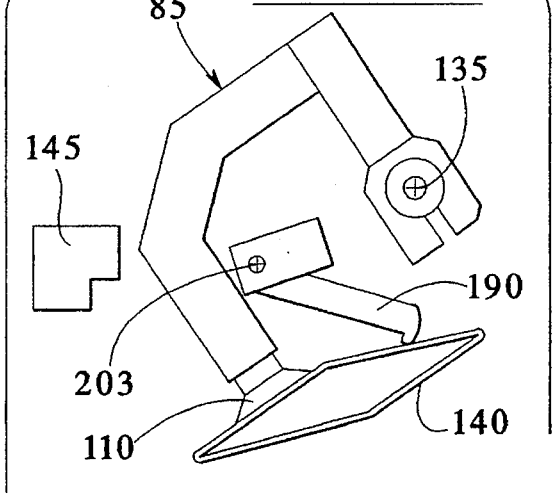
Figure 14:
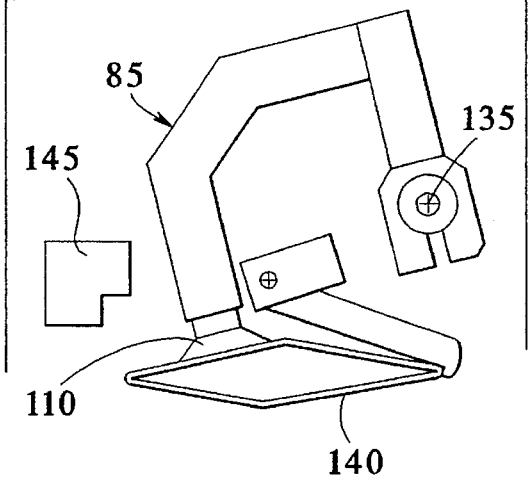
Figure 15:
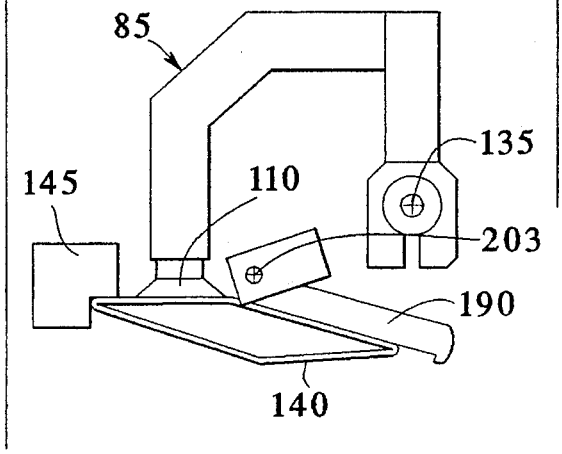
Figure 16:
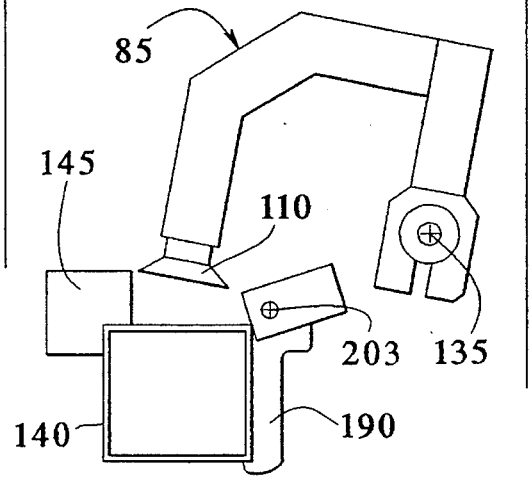

The cams 224 and 240 may be driven by the same motor or, alternatively, by individual servomotors 265 and 270 that are controlled by a controller 275, such as illustrated FIG. 9. Alternatively, the cams 274 and 240 may be driven by individual gearing mechanisms 280 and 285 that, in turn, are driven by a timing chain 290, such as illustrated in FIG. 10. Alternatively, the shafts 115 and 205 may be directly driven by the illustrated drive mechanisms. In such instances, the connection is to the shafts 115 and 205 instead of to the shafts 228 and 260.

FIGS. 5 and 6 are partial top views of the carton picking/erecting apparatus which illustrate the relative movement of the picking assembly 85 and the gate 190. FIG. 5 illustrates the gate 190 and the picking assembly 85 in their respective first positions. In this first position, the length of the gate 190 is directed toward the magazine 60 while the suction cups 110 of the picking assembly 85 engage the carton blank 140. FIG. 6 illustrates the gate 190 and the picking assembly 85 after both have moved to their respective second positions. In this second position, the picking assembly 85 has moved the carton blank 140 into engagement with the abutment 145 where the sidewalls 150 and 155 engage the first and second side panels of the carton blank 145. The gate 190 has been rotated to apply an erecting force to, for example, the third side panel of the carton 140. In this position, the hooked portion 200 of the gate 190 engages the corner of the carton blank 140 diagonal from the corner that engages the abutment 145. The elongated body portion 195 of the gate 190 is engaged with, for example, the third side panel of the carton blank 140.

FIGS. 11–16 illustrate the relative movement of the gate 190 and the picking assembly 85 as they move from their respective first positions to their respective second positions. As illustrated, the picking assembly 85 begins the cycle by moving toward and engaging the first panel of the inner most facing carton blank 140 in magazine 60. At this position, a vacuum is applied to the suction cups 110 by the vacuum generator to allow the suction cups to grip the blank 140. The gate 190 remains in or goes to the position illustrated in FIG. 7 so as not to interfere with the movement and operation of the picking assembly 85.

As the picking assembly 85 is rotated about the axis, the fourth side panel of carton blank 140 contacts gate 190. This contact applies a breaking pressure to the carton blank and causes the carton blank to unfold or "break" into a partially open, parallelogram shape. Breaking the unfolded carton blank in this manner facilitates airflow into the carton interior to assist in further carton erection, even at high operation speeds. As the picking assembly continues to pivot, carton blank 140 continues to "break" and/or otherwise remains open. The picking assembly 85 continues its rotation until a corner of carton blank 140 engages abutment member 145.

At or just prior to the time that carton blank 140 engages abutment member 145, gate 190 pivots about axis 203. As the gate 190 moves, it applies an erecting force to the fourth panel of carton blank 140 and thereby assists in completely unfolding the carton blank. The vacuum is then removed from suction cups 110, and the unfolded carton blank may be removed from the area of the picking and erecting by, for example, the lift plate 175 or another picking arm and placed on a transport mechanism, such as a rotary or linear conveyor illustrated at 300 in FIGS. 3 and 4, for transport to additional filling and sealing stations.

Figure 17:
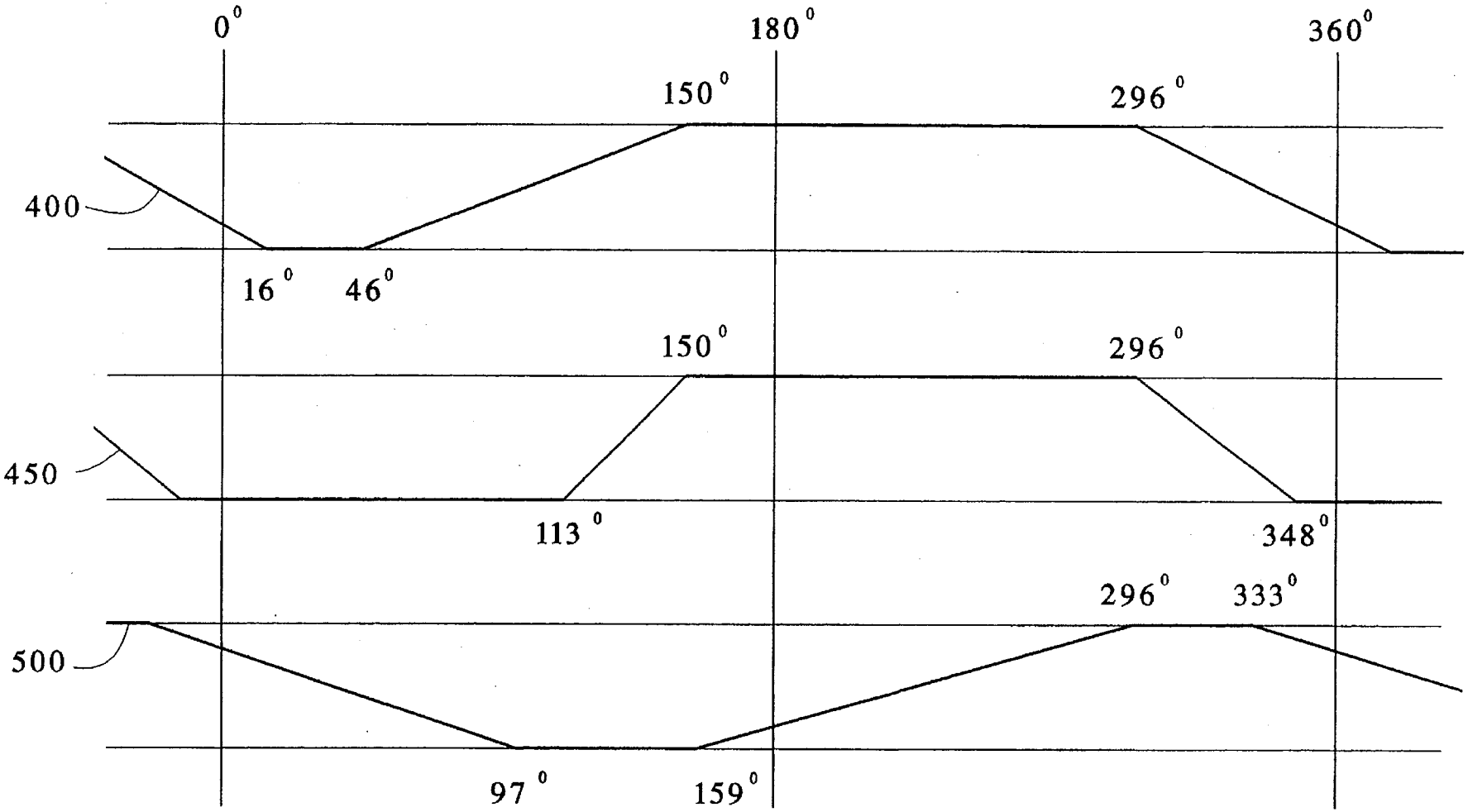
FIG. 17 is a graph illustrating one motion profile for the gate, picking assembly, and lifter of the disclosed apparatus.

FIG. 17 illustrates one of the many timing relationships between the movement of the picking assembly 85, the gate 190, and the lifter 175. As illustrated, the graph tracks one operational cycle of these components with line 400 representing the movement of the picking assembly, line 450 representing the movement of the gate 190, and line 500 representing the movement of the lifter 175.

While a particular embodiment and method of the invention are shown, it will be understood, of course, that the invention is not limited thereto since modifications may be made by those skilled in the art, particularly in light of the foregoing teachings. It is therefore contemplated by the appended claims to cover any such modifications as incorporate those features which constitute the essential features of these improvements within the true spirit and the scope of the invention.

What is claimed is:

1. An apparatus for picking a folded tubular carton blank from a magazine and erecting the carton blank into a generally rectangular tube, the carton blank having first, second, third, and fourth side panels and being positioned within the magazine such that the second and third side panels are exposed at a dispensing side of the magazine, the apparatus comprising:

an abutment mounted to align with a first corner of the carton blank as the carton blank is being erected, the first corner being formed between the second and third side panels;

a picking means for grasping the carton blank from the magazine, the picking means disposed for rotation from a first position proximate the magazine to a second position proximate the abutment;

a gate disposed for rotation from a first position to a second position;

rotational drive means for rotating the picking means from its first position to its second position and for rotating the gate from its first position to its second position, the gate being driven in a timed relation with the picking means to apply an initial breaking pressure to the carton blank when the gate is in the first position thereby to facilitate air flow to the interior of the carton blank and to apply a subsequent erecting pressure to the carton blank as the gate is moved from the first position to the second position thereby to guide the carton against the abutment to complete erection of the carton blank.

2. An apparatus as claimed in claim 1 wherein the picking means comprises:

a manifold;

at least one suction cup in fluid communication with the manifold;

a base member disposed for rotation about an axis;

at least one arm connecting the base member to the manifold.

3. An apparatus as claimed in claim 1 wherein the rotational drive means maintains the gate in the first position for a period of time in which the picking means is moved from its first position to its second position, rotation of the picking means from its first to its second position urging the carton blank against the gate to apply the breaking pressure.

4. An apparatus as claimed in claim 1 wherein the gate comprises an elongated body portion and a hooked end portion, the hooked end portion adapted to engage a corner of the carton blank diagonal from the abutment.

5. An apparatus as claimed in claim 1 wherein the picking means grasps the carton blank at the first panel and wherein the gate engages the third panel of the carton blank as the picking means moves from its first position to its second position thereby applying said breaking force.

6. An apparatus as claimed in claim 1 wherein the abutment comprises:

a first face portion that is generally parallel with a dispensing portion of the magazine; and a second face portion that is generally perpendicular to the first face portion.

7. An apparatus as claimed in claim 1 wherein the rotational drive means comprises:

a first servomotor connected to drive the picking means;

a second servomotor connected to drive the gate; and a controller connected to the first and second servomotors to controlling the timing of the movement of the picking means and the gate.

8. An apparatus as claimed in claim 1 wherein the rotational drive means comprises:

a timing chain;

a first gearing mechanism disposed between the timing chain and the picking means for effecting timed rotational movement of the picking means; and a second gearing mechanism disposed between the timing chain and the gate for effecting time rotational movement of the gate.

9. An apparatus as claimed in claim 1 wherein the rotational drive means comprises:

a first crank assembly connected to drive the picking means; and a second crank assembly connected to drive the gate.

10. An apparatus for picking a folded carton blank from a magazine and erecting the carton blank into a generally rectangular tube, the apparatus comprising:

an abutment mounted to align with a first corner of the carton blank as the carton blank is being erected;

a pivoting picking arm for grasping a face of the carton blank from the magazine and moving the carton blank into engagement with the abutment; and a pivoting gate, pivoting movement of the picking arm causing the gate to engage the carton blank as the picking arm moves the carton blank toward the abutment thereby to apply a breaking force to the carton blank to facilitate air flow into the interior of the carton blank, the gate pivoting to engage the carton blank to apply an erecting pressure to the carton blank after the carton blank has been broken to thereby urge the carton blank against the abutment to a fully erect state.

11. An apparatus as claimed in claim 10 wherein the picking arm comprises:

a manifold;

at least one suction cup in fluid communication with the manifold;

a base member disposed for rotation about an axis; and at least one arm connecting the base member to the manifold.

12. An apparatus as claimed in claim 10 and further comprising drive means for moving the picking arm and the gate in a timed relationship.

13. An apparatus as claimed in claim 12 wherein the drive means drives the gate from a first position in which the gate applies the breaking force to a second position in which the gate applies the erecting force.

14. An apparatus as claimed in claim 13 wherein the drive means drives the picking arm from a first position in which the picking arm engages the carton blank at the magazine to a second position in which the carton blank engages the abutment.

15. An apparatus as claimed in claim 14 wherein the drive means maintains the gate in the first position for a period of time in which the picking arm is moved from its first position to its second position, movement of the picking arm from its first position to its second position urging the carton blank against the gate to apply the breaking pressure.

16. An apparatus as claimed in claim 12 wherein the drive means comprises:

a first servomotor connected to drive the picking arm;

a second servomotor connected to drive the gate; and a controller connected to the first and second servomotors to control the timing of the movement of the picking arm and the gate.

17. An apparatus as claimed in claim 12 wherein the drive means comprises:

a timing chain;

a first gearing mechanism disposed between the timing chain and the picking arm for effecting timed movement of the picking arm; and a second gearing mechanism disposed between the timing chain and the gate for effecting timed movement of the gate.

18. An apparatus as claimed in claim 12 wherein the drive means comprises:

a first crank assembly connected to drive the picking arm; and a second crank assembly connected to drive the gate.

19. A method for picking a folded carton blank from a magazine and erecting the carton blank into a generally rectangular tube, the method comprising the steps of:

grasping the carton blank at the magazine with a pivoting picking arm;

moving the carton blank with the pivoting picking arm from a first position proximate the magazine to a second position in which a corner of the carton blank engages an abutment;

applying a breaking pressure to the carton blank with a pivoting gate as the carton bank is moved by the pivoting picking arm from the first position to the second position, the breaking pressure resulting from relative movement between the pivoting gate and the pivoting picking arm; and applying a subsequent erecting pressure to the carton blank by pivoting the pivoting gate about an axis to urge the carton blank against the abutment thereby fully erecting the carton blank.

20. A method as claimed in claim 19 wherein the step of grasping is further defined by grasping the carton blank at the magazine with suction cups of a picking arm.

21. A method as claimed in claim 19 wherein the step of applying a subsequent erecting pressure is further defined by applying the subsequent erecting pressure to the carton blank only after the corner of the carton blank has been moved into engagement with the abutment.

* * * * *

UNITED STATES PATENT AND TRADEMARK OFFICE

CERTIFICATE OF CORRECTION

PATENT NO. : 5,536,231

DATED : July 16, 1996

INVENTOR(S) : Jan-Osten Nilsson

It is certified that error appears in the above-indentified patent and that said Letters Patent is hereby corrected as shown below:

Column 3, line 40, delete "20"--.

Column 8, line 9, delete "rotation" and insert --pivotal movement--.

Signed and Sealed this

Seventeenth Day of December, 1996

*Attest:*

*Attesting Officer*

BRUCE LEHMAN

*Commissioner of Patents and Trademarks*